US009353774B2

(12) United States Patent
Ito et al.

(10) Patent No.: US 9,353,774 B2
(45) Date of Patent: May 31, 2016

(54) FLUID ACTUATOR

(75) Inventors: Koji Ito, Gifu (JP); Masanori Hirai, Gifu (JP)

(73) Assignee: NABTESCO CORPORATION, Tokyo (JP)

( * ) Notice: Subject to any disclaimer, the term of this patent is extended or adjusted under 35 U.S.C. 154(b) by 716 days.

(21) Appl. No.: 13/586,791

(22) Filed: Aug. 15, 2012

(65) Prior Publication Data

US 2013/0047838 A1 Feb. 28, 2013

(30) Foreign Application Priority Data

Aug. 22, 2011 (JP) ..... 2011-180308

(51) Int. Cl.
*F01B 9/00* (2006.01)
*F15B 15/06* (2006.01)

(52) U.S. Cl.
CPC ..... *F15B 15/06* (2013.01); *F15B 15/063* (2013.01)

(58) Field of Classification Search
CPC ..... F15B 15/16; F15B 15/06; F15B 15/063
USPC ..... 92/140; 244/99.2–99.623; 416/23
See application file for complete search history.

(56) References Cited

U.S. PATENT DOCUMENTS

| | | | | |
|---|---|---|---|---|
| 3,670,341 | A | 6/1972 | Webb et al. | |
| 4,598,890 | A | 7/1986 | Herzog et al. | |
| 4,649,484 | A | 3/1987 | Herzog et al. | |
| 5,701,801 | A * | 12/1997 | Boehringer et al. | 92/166 |
| 8,858,171 | B2 | 10/2014 | Parker | |
| 2011/0162522 | A1 | 7/2011 | Tunkers | |
| 2012/0006939 | A1 | 1/2012 | Parker | |

FOREIGN PATENT DOCUMENTS

| | | | |
|---|---|---|---|
| DE | 202004019495 | U1 | 3/2005 |
| FR | 90991 | E | 3/1968 |
| JP | S60-25690 | A | 2/1985 |
| JP | S62-15200 | A | 1/1987 |

(Continued)

OTHER PUBLICATIONS

The extended European search report issued on Aug. 7, 2013, which corresponds to EP12180307.6 and is related to U.S. Appl. No. 13/586,791.

(Continued)

*Primary Examiner* — F. Daniel Lopez
*Assistant Examiner* — Daniel Collins
(74) *Attorney, Agent, or Firm* — Studebaker & Brackett PC

(57) ABSTRACT

A fluid is supplied and discharged to and from a cylinder. A body portion is fixed to a fixed-side structure, and the cylinder is provided integrally with the body portion. A piston defines a cylinder chamber inside the cylinder and slides on an inner wall of the cylinder. A rod is provided integrally with the piston and is displaced so as to extend from and contract into the cylinder. A link member is installed parallel to the axial direction of the cylinder or installed so as to extend obliquely to a direction parallel to the axial direction of the cylinder, and a first end of the link member is pivotably connected to a movable-side structure. A connecting member is fixed to the rod, and a second end of the link member is pivotably connected to the connecting member.

6 Claims, 7 Drawing Sheets

(56) References Cited

FOREIGN PATENT DOCUMENTS

| | | | |
|---|---|---|---|
| JP | 2000-065011 | A | 3/2000 |
| JP | 2012-500366 | A | 1/2012 |
| WO | 2010/084338 | A2 | 7/2010 |
| WO | 2010127690 | A1 | 11/2010 |

OTHER PUBLICATIONS

An Office Action; "Notification of Reasons for Refusal," issued by the Japanese Patent Office on Oct. 7, 2014, which corresponds to Japanese Patent Application No. 2011-180308 and is related to U.S. Appl. No. 13/586,791; with English language translation.

* cited by examiner

FLUID ACTUATOR

CROSS-REFERENCE TO RELATED APPLICATION

This application claims priority to Japanese Patent Application No. 2011-180308. The entire disclosure of Japanese Patent Application No. 2011-180308 is hereby incorporated herein by reference.

BACKGROUND OF THE INVENTION

1. Field of the Invention

The present invention relates to a fluid actuator that is operated by supply and discharge of a fluid and that pivotably drives a movable-side structure pivotably connected to a fixed-side structure.

2. Description of Related Art

As a fluid actuator that is operated by supply and discharge of a fluid and that pivotably drives a movable-side structure pivotably connected to a fixed-side structure, JP 2000-65011A discloses a fluid actuator for driving a control surface of an aircraft. The fluid actuator disclosed in FIG. 9 of a JP 2000-65011A includes a cylinder body (12), a piston (13), a rod (15) to which the piston (13) is fixed, and a link (19). A first end of the link (19) is pivotably connected to the rod (15), and a second end thereof is pivotably connected to a member on the control surface serving as a movable-side structure.

The fluid actuator disclosed in FIG. 1 of JP 2000-65011A includes a cylinder body (35), a piston (36), a cylindrical outer cylinder (38) whose proximal end is formed integrally with the piston (36), and a rod (39). The rod (39) is loosely fitted in the outer cylinder (38) on its proximal end side, and the proximal end is fixed to the piston (36). Moreover, the distal end of the rod (39) is pivotably connected to a member on the side of the control surface serving as a movable-side structure, and the rod (39) is formed of a material having a relatively small Young's modulus such that it can easily undergo bending deformation.

SUMMARY OF THE INVENTION

With the fluid actuator disclosed in JP 2000-65011A, the movable-side structure connected via the link or directly to the rod is driven by the rod extending from and contracting into the cylinder body fixed to the fixed-side structure. Accordingly, the cylinder body will not pivot relative to the fixed-side structure, and therefore, the compactness of the installation space for the fluid actuator can be increased.

However, with the fluid actuator disclosed in JP 2000-65011A, a reaction force generated during driving of the movable-side structure acts on the rod, and thereby, a force in the bending direction that is perpendicular to the axial force direction also acts on the rod.

In the case of the fluid actuator disclosed in FIG. 9 of JP 2000-65011A, a force in the bending direction causes the rod to be pressed against a through hole of the distal end wall of the cylinder body. Accordingly, if the force in the bending direction increases, there is the possibility of occurrence of seizure or adhesion, for example. In this respect, the force in the bending direction can be reduced by increasing the length of the link connecting the rod and the movable-side structure. However, this leads to an increase in length and size of the fluid actuator, which makes it difficult to increase the compactness of the installation space.

On the other hand, in the case of the fluid actuator disclosed in FIG. 1 of JP 2000-65011A, the rod is loosely fitted in the outer cylinder, and is formed of a material that can easily undergo bending deformation. Accordingly, it is possible to prevent the rod from being pressed against the through hole of the distal end wall of the cylinder body. However, due to the structure in which the movable-side structure is driven by bending the rod loosely fitted in the outer cylinder, the structure of the rod tends to be subjected to a constraint. Moreover, this constraint tends to result in a constraint also on the pivotable range of the movable-side structure, which becomes pivotable by bending of the rod. It is conceivable to reduce the stress at the rod generated by the force in the bending direction, by adopting a configuration in which the rod extends from the outer cylinder by an increased length, thus relaxing the constraint on the pivotable range of the movable-side structure caused by the bending of the rod. However, this leads to an increase in length and size of the fluid actuator.

In view of the foregoing circumstances, it is an object of the present invention to provide a fluid actuator that can significantly reduce the force in the bending direction acting on the rod, while suppressing generation of a constraint on the rod structure, and also can increase the compactness of the installation space by suppressing an increase in length and size.

According to a first aspect of a fluid actuator of the present invention for achieving the above-described object, there is provided a fluid actuator that is operated by supply and discharge of a fluid and that pivotably drives a movable-side structure pivotably connected to a fixed-side structure, the fluid actuator including: a cylinder to and from which a fluid is supplied and discharged; a body portion that is fixed to the fixed-side structure and with which the cylinder is provided integrally or to which the cylinder is fixed; a piston that defines a cylinder chamber inside the cylinder and that slides on an inner wall of the cylinder; a rod that is provided integrally with or fixed to the piston and that is displaced so as to extend from and contract into the cylinder; a link member that is installed so as to extend parallel to the axial direction of the cylinder or installed so as to extend obliquely to a direction parallel to the axial direction of the cylinder and whose first end is pivotably connected to the movable-side structure; and a connecting member that is fixed to the rod and to which a second end of the link member is pivotably connected.

With this configuration, the rod is displaced parallel to the cylinder axial direction with the movement of the piston, and extends from and contracts into the cylinder. As a result of the extension/contraction operation of the rod, the connecting member fixed to the rod is displaced, which causes the link member to pivot, thus pivotably driving the movable-side structure. Furthermore, with the above-described configuration, the link member whose first end is pivotably connected to the movable-side structure is installed parallel or obliquely to the cylinder axial direction, and the second end of the link member is pivotably connected to the connecting member fixed to the rod. Accordingly, the drive output resulting from the extension/contraction operation of the rod can be exerted on the movable-side structure on the opposite side from the side on which the rod projects from the cylinder such that the drive output is inverted via the connecting member and the link member. Thus, with the above-described configuration, due to the structure in which the link member is installed in alignment with the cylinder, it is possible to suppress an increase in length and size of the fluid actuator, without reducing the output level, and secure a sufficient length of the link member by efficiently utilizing the space around the cylinder. This can significantly reduce the force in the bending direction that acts on the rod. Also, with the above-described configuration, due to the structure in which the motions of the rod on the cylinder output side and the motions of the link member are inverted, the distance between the pivot center about which the movable-side structure pivots relative to the fixed-side structure and the pivot center about which the link member pivots relative to the movable-side structure can be set short, which makes it possible to decrease the installation space for the fluid actuator. Accordingly, for example, when the fluid actuator is used as an actuator for driving a control surface, it is possible to decrease the loading envelope serving as the installation space for the fluid actuator in the wing, thus coping with the thinned wing.

Further, with the above-described configuration, there is no such constraint as in a structure in which the movable-side structure is driven by bending the rod loosely fitted in the outer cylinder. Accordingly, it is possible to suppress generation of a constraint on the structure of the rod. Furthermore, with the above-described configuration, the body portion provided integrally with or fixed to the cylinder is fixed to the fixed-side structure, and therefore, the cylinder will not pivot relative to the fixed-side structure. Thus, with the above-described configuration, the cylinder will not pivot relative to the fixed-side structure, and moreover, an increase in length and size of the fluid actuator can be suppressed. Therefore, it is possible to increase the compactness of the installation space.

Therefore, with the above-described configuration, it is possible to provide a fluid actuator that can significantly reduce the force in the bending direction that acts on the rod, suppress generation of a constraint on the structure of the rod, and also increase the compactness of the installation space by suppressing an increase in length and size.

According to a second aspect of a fluid actuator of the present invention, in the fluid actuator of the first aspect, a plurality of the rods installed parallel to each other are provided, and the link member is installed in a position that overlaps a region between the plurality of the rods in a direction perpendicular to a plane in which the plurality of the rods are aligned parallel to each other.

With this configuration, the link member is installed in a position that overlaps a region between the plurality of the rods in the perpendicular direction, and it is therefore possible to transmit the drive output to the movable-side structure in a stable and efficient manner, using a smaller number of the link members than the number of the rods. This can efficiently ensure further stability of operation with a light-weight structure.

According to a third aspect of a fluid actuator of the present invention, in the fluid actuator of the first or second aspect, a plurality of the rods installed parallel to each other are provided, and the connecting member is fixed to the plurality of the rods so as to couple ends of the plurality of the rods together.

With this configuration, the plurality of rods are coupled together with the connecting member, and it is therefore possible to efficiently prevent the occurrence of a force fight in which the plurality of rods bias the link member in opposite directions due to displacement between the positions of the rods. This can efficiently achieve further stability of operation and the synchronization of operation.

It should be appreciated that the above and other objects, and features and advantages of the present invention will become apparent from the following description taken in conjunction with the accompanying drawings.

DETAILED DESCRIPTION OF THE INVENTION

Hereinafter, an embodiment of the present invention will be described with reference to the accompanying drawings. In the following embodiment, a description will be given, taking as an example, a fluid actuator configured to be used for driving a moving surface of an aircraft. However, the present invention is not limited to the configurations described in the following embodiment as examples, and is widely applicable to a fluid actuator that is operated by supply and discharge of a fluid and that pivotably drives a movable-side structure pivotably connected to a fixed-side structure. For example, the present invention is applicable to fluid actuators used in aircrafts, helicopters, or flying objects. Furthermore, the present invention is applicable to both fluid actuators used in manned aircrafts and helicopters and those used in unmanned aircrafts and helicopters.

Figure 1:
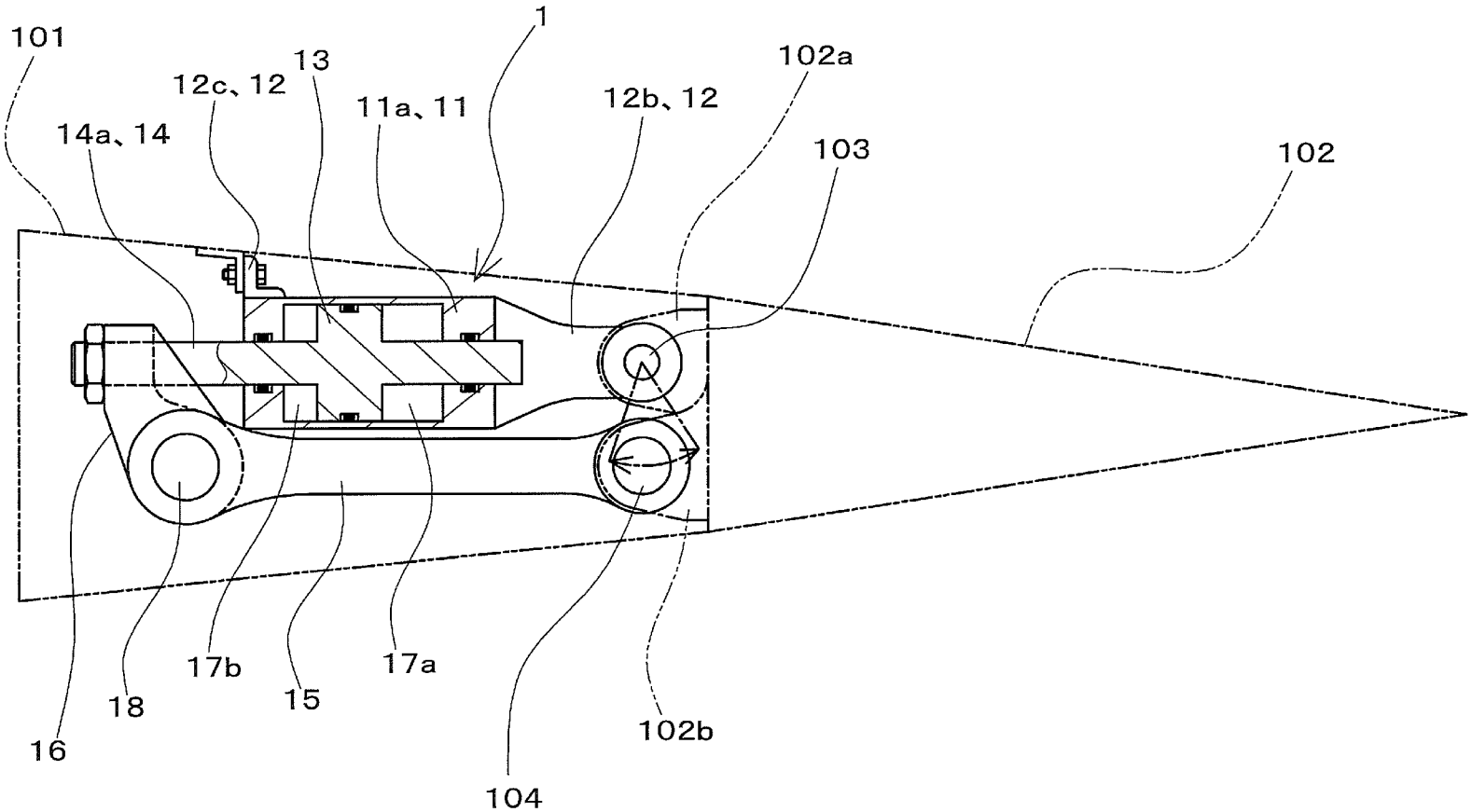
FIG. 1 is a schematic diagram showing a state in which a fluid actuator according to one embodiment of the present invention has been attached to a wing and a control surface of an aircraft.

FIG. 1 is a schematic diagram showing a state in which a fluid actuator 1 according to one embodiment of the present invention has been attached to a wing 101 and a control surface 102 of an aircraft. The fluid actuator 1 shown in FIG. 1 is installed at the aircraft, with has its principal part omitted in this illustration showing only the wing 101 and the control surface 102 by the two-dot chain line in FIG. 1. The fluid actuator 1 is used for driving the control surface 102 of the aircraft.

This embodiment describes, as an example, a fixed-side structure configured as the wing 101, a movable-side structure configured as the control surface 102 pivotably connected to the wing 101 via a fulcrum shaft 103, and the fluid actuator 1 that pivotably drives the control surface 102. Examples of aircraft moving surfaces (flight control surfaces) constituting the control surface 102 include an aileron, a rudder, and an elevator. The fluid actuator 1 may also be used as a mechanism for driving a moving surface configured as a flap, a spoiler, and the like.

Recently, there is a need for coping with thinned wings, i.e., the reduction of the wing thickness, for the purpose of increasing the efficiency of the aircraft body to increase the fuel efficiency. Also, with the need for coping with thinned wings, there is a demand for increasing the compactness of a loading envelope serving as the installation space for the fluid actuator installed at the wing, without reducing the output level of the fluid actuator. In this respect, with the fluid actuator 1, it is possible to increase the compactness of the installation space by suppressing an increase in length and size, without reducing the output level, as will be described below. Accordingly, the fluid actuator 1 is preferable as a mechanism for driving the control surface 102 pivotably connected to the wing 101 that has been thinned.

Figure 2:
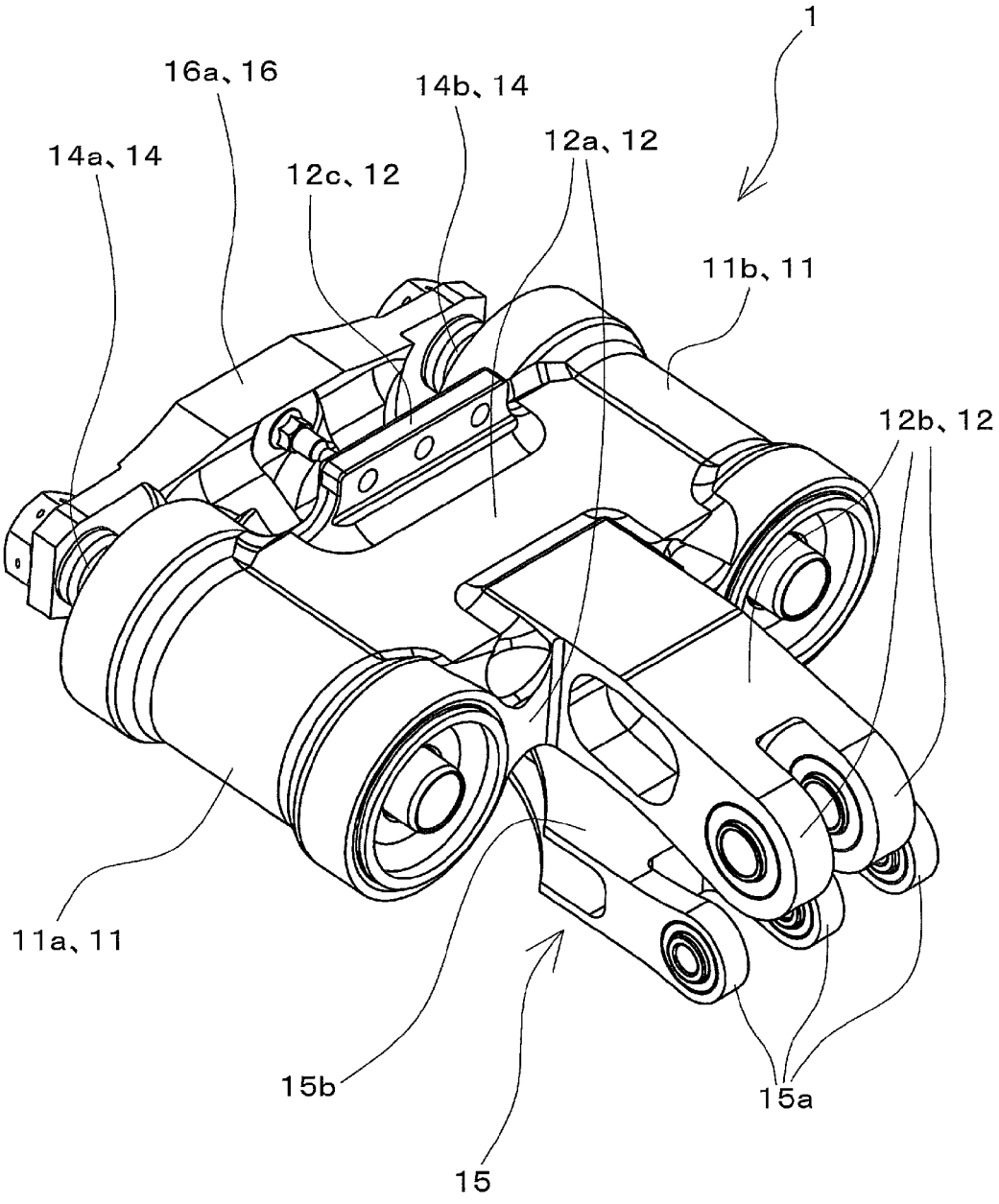
FIG. 2 is a perspective view of the fluid actuator shown in FIG. 1.
Figure 3:
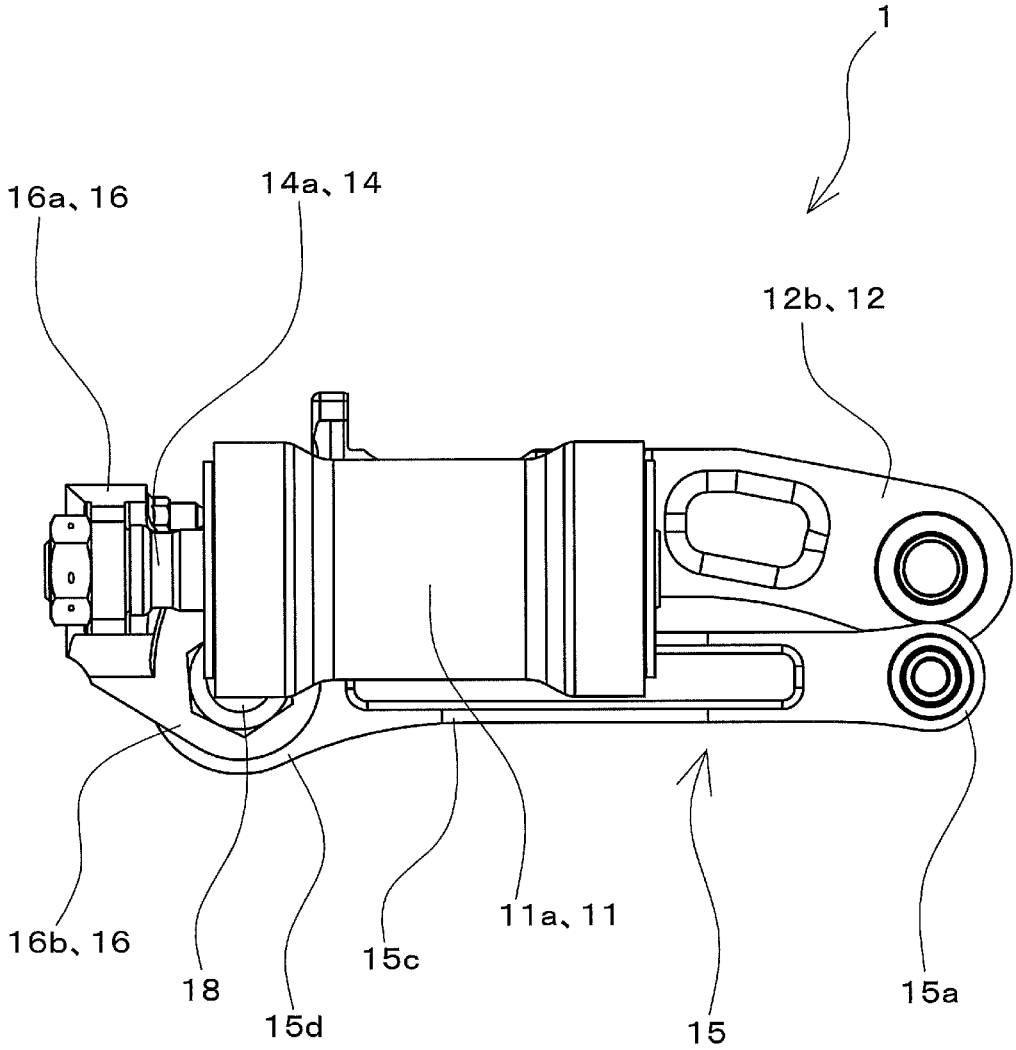
FIG. 3 is a front view of the fluid actuator shown in FIG. 2.
Figure 4:
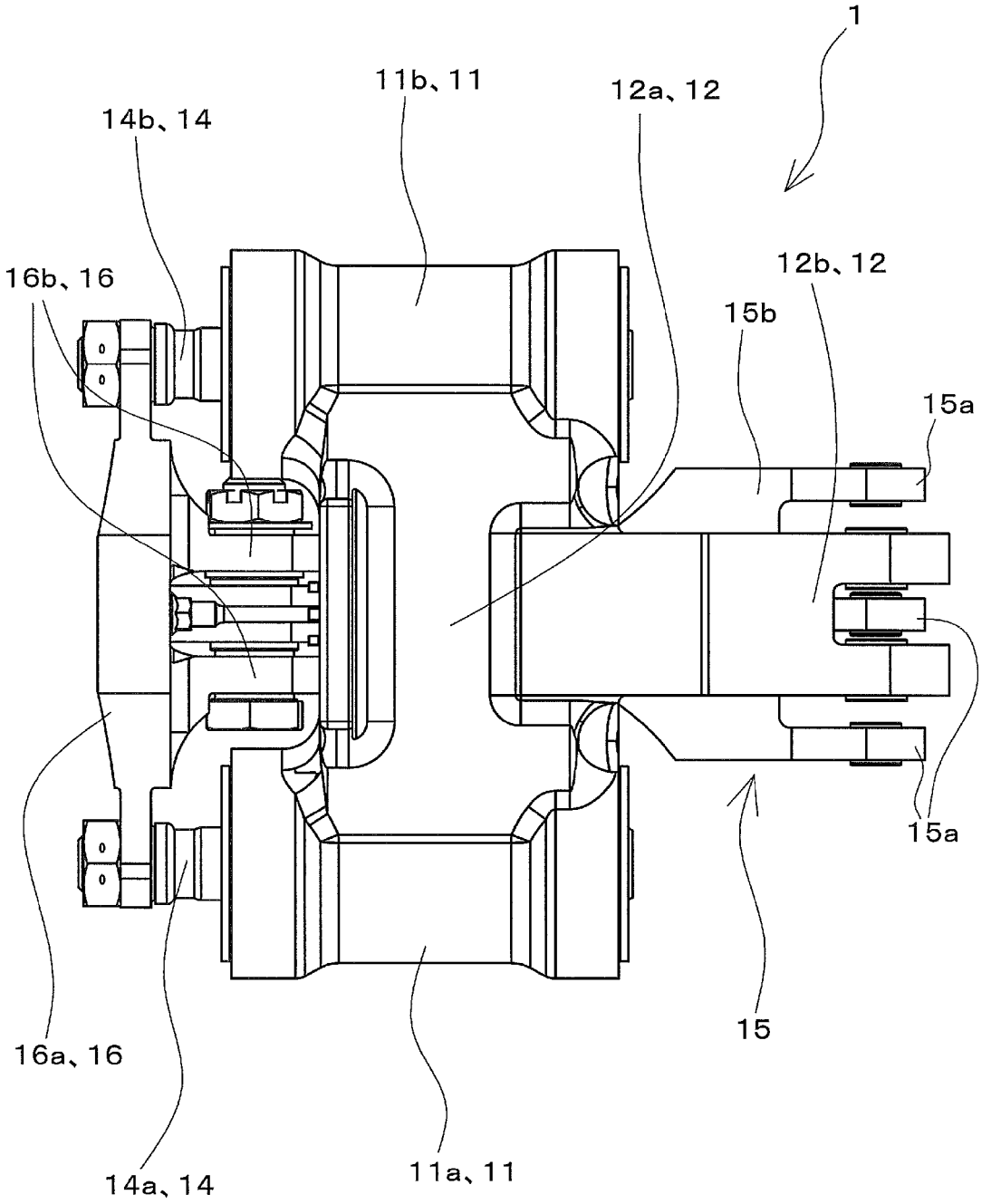
FIG. 4 is a plan view of the fluid actuator shown in FIG. 2.
Figure 5:
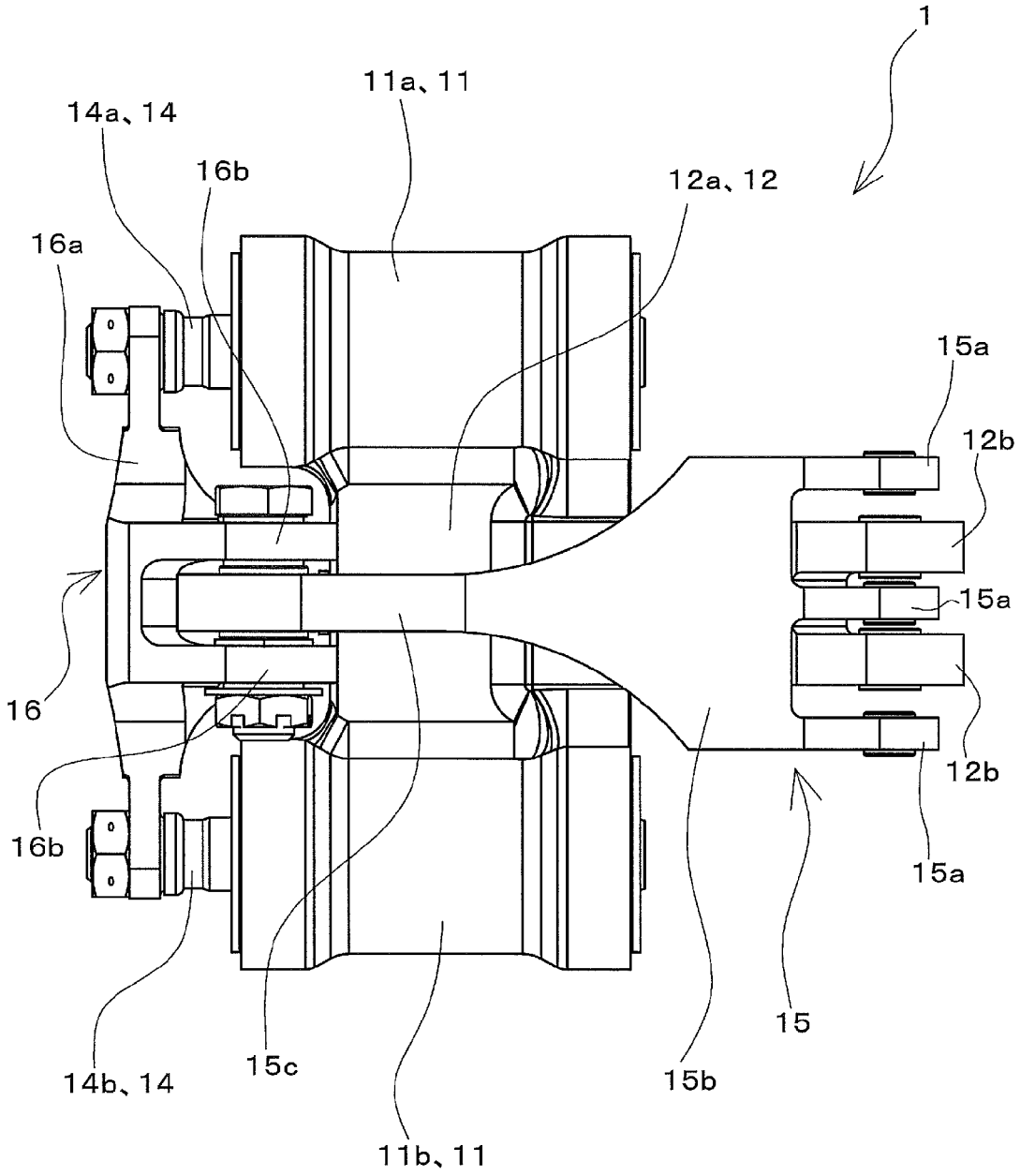
FIG. 5 is a bottom view of the fluid actuator shown in FIG. 2.
Figure 6:
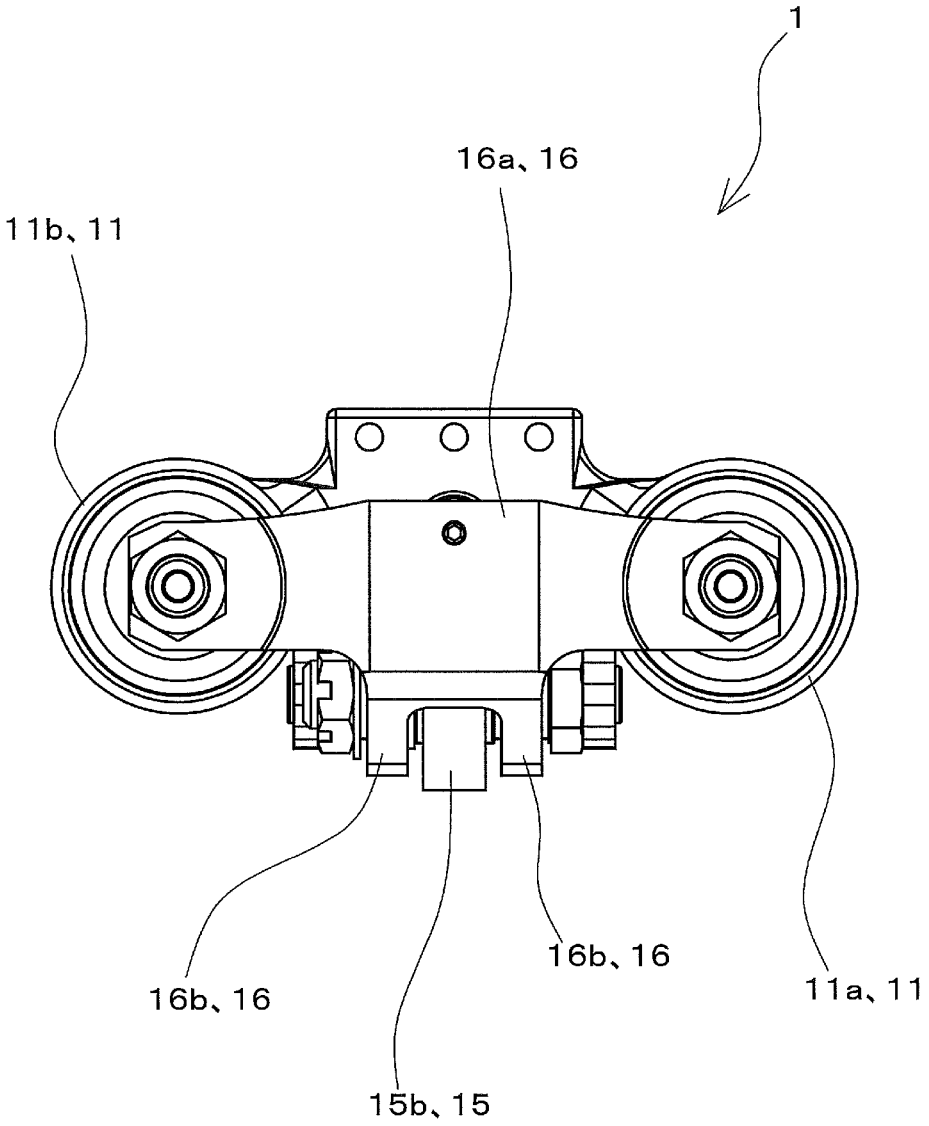
FIG. 6 is a side view of the fluid actuator shown in FIG. 2.
Figure 7:
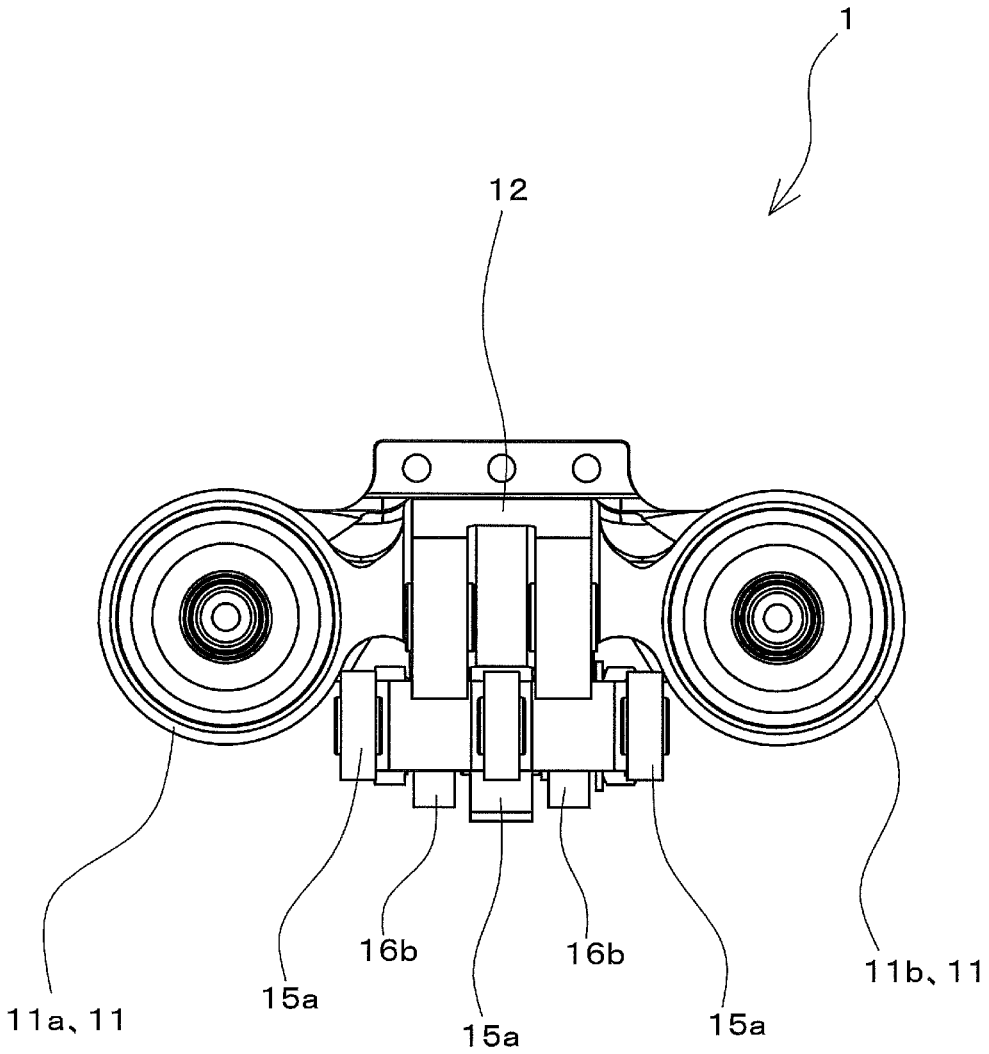
FIG. 7 is a side view of the fluid actuator shown in FIG. 2.

Hereinafter, the fluid actuator 1 will be described in detail with reference to FIGS. 1 to 7. FIG. 2 is a perspective view of the fluid actuator 1. FIG. 3 is a front view of the fluid actuator 1. FIG. 4 is a plan view of the fluid actuator 1. FIG. 5 is a bottom view of the fluid actuator 1. FIG. 6 is a left side view of the fluid actuator 1. FIG. 7 is a right side view of the fluid actuator 1.

The fluid actuator 1 shown in FIGS. 1 to 7 includes cylinders 11 (11*a*, 11*b*), a body portion 12, pistons 13, rods 14 (14*a*, 14*b*), a link member 15, a connecting member 16, and so forth. Note that in FIG. 1, a part of the rod 14*a*, a piston 13, and the cylinder 11*a* are shown in cross section.

A plurality of cylinders 11 can be provided, and two cylinders 11*a* and 11*b* that are installed such that the cylinder axial directions are parallel to each other are provided in this embodiment. Each of the cylinders (11*a*, 11*b*) is provided as a cylindrical structure part to and from which a fluid is supplied and discharged. Note that each of the cylinders (11*a*, 11*b*) is provided, at opposite ends, with end walls through which a rod 14 passes through. Also, a pressure fluid is supplied to the inside of the cylinders (11*a*, 11*b*) from a fluid feeder installed on the body side of the aircraft, which is not shown. Note that examples of the pressure fluid include pressure oil, pressure liquids other than pressure oil, and compressed air, and pressure oil is supplied as the pressure fluid in this embodiment.

The body portion 12 is configured as a structure part that is fixed to the wing 101 serving as the fixed-side structure and with which the plurality of cylinders (11*a*, 11*b*) are provided integrally. The body portion 12 includes a bridging portion 12*a*, a fulcrum shaft attachment portion 12*b*, a fixing portion 12*c*, and so forth.

The bridging portion 12*a* is provided as a portion that couples together the cylinder 11*a* and the cylinder 11*b*, which are installed parallel to each other, in a bridging manner. The fixing portion 12*c* is provided integrally with the bridging portion 12*a*, and is provided as a portion that is fixed to the wing 101, for example, via fastening members. For example, the fixing portion 12*c* is provided as a portion projecting from the bridging portion 12*a* toward a direction perpendicular to the plane in which the cylinder 11*a* and the cylinder 11*b* are aligned.

The fulcrum shaft attachment portion 12*b* is formed integrally with the bridging portion 12*a*, and is provided as a portion projecting from the bridging portion 12*a* along a direction parallel to the axial direction of the cylinders (11*a*, 11*b*) toward the control surface 102 side. Note that in this embodiment, the fulcrum shaft attachment portion 12*b* is provided so as to extend in a bending manner at its distal end such that it is slightly inclined with respect to the axial direction of the cylinders (11*a*, 11*b*).

The fulcrum shaft attachment portion 12*b* is attached to the fulcrum shaft 103 that pivotably supports the control surface 102 serving as the movable-side structure relative to the wing 101 side at its distal end projecting from the bridging portion 12*a*. Note that the fulcrum shaft attachment portion 12*b* is rotatably attached to the fulcrum shaft 103, for example, via a bush serving as a bearing or a cylindrical sliding member. The control surface 102 is provided with a fulcrum-side connection portion 102*a* rotatably connected to the fulcrum shaft 103 (see FIG. 1). The end of the fulcrum shaft attachment portion 12*b* that is rotatably attached to the fulcrum shaft 103 is bifurcated, and the fulcrum-side connection portion 102*a* of the control surface 102 is connected to the fulcrum shaft 103 between the bifurcated end portions.

A plurality of pistons 13 are provided, and they are respectively installed inside the cylinders (11*a*, 11*b*). The pistons 13 define a pair of cylinder chambers (17*a*, 17*b*) inside the respective cylinders (11*a*, 11*b*). The pistons 13 are installed in the respective cylinders (11*a*, 11*b*) so as to be slidable on the inner walls of the cylinders (11*a*, 11*b*).

Note that the pressure fluid supplied from the fluid feeder of the aircraft is supplied to one of the paired cylinder chambers (17*a*, 17*b*), and the fluid is discharged from the other of the paired cylinder chambers (17*a*, 17*b*) at the same timing with the supply timing. This causes the pistons 13 to be displaced relative to the respective cylinders (11*a*, 11*b*). Further, the fluid discharged from the other of the paired cylinder chambers (17*a*, 17*b*) is returned to a reservoir circuit installed on the body side of the aircraft, and after the pressure of the fluid is raised by the above-described fluid feeder, the fluid is circulated for use. The supply path and the discharge path of the fluid to and from the cylinder chambers (17*a*, 17*b*) are switched by a control valve, which is not shown.

A plurality of rods 14 are provided, and two rods 14*a* and 14*b* that are provided integrally, respectively, with the pistons 13 are provided. The plurality of rods (14*a*, 14*b*) are installed parallel to each other. Also, the rods (14*a*, 14*b*) are displaced together with the respective pistons 13 so as to extend from and contract into the cylinders (11*a*, 11*b*). Note that the rod 14*a* is installed so as to extend from and contract into the cylinder 11*a*, whereas the rod 14*b* is installed so as to extend from and contract into the cylinder 11*b*. Further, the rods (14*a*, 14*b*) that are installed so as to extend coaxially with the cylinders (11*a*, 11*b*) are installed so as to project to the outside from the end walls of the cylinders (11*a*, 11*b*) toward the opposite side from the fulcrum shaft attachment portion 12*b*.

In this embodiment, one link member 15 is provided as a member that is installed so as to extend parallel or slightly obliquely to the axial direction of the cylinders (11*a*, 11*b*). The link member 15 includes a pivot shaft attachment portion 15*a*, a widened portion 15*b*, a shaft portion 15*c*, and a connecting shaft attachment portion 15*d*. The pivot shaft attachment portion 15*a*, the widened portion 15*b*, the shaft portion 15*c*, and the connecting shaft attachment portion 15*d* are provided integrally, and are arranged in series in this order from a first end of the link member 15 to a second end thereof.

The pivot shaft attachment portion 15*a* is provided as the first end of the link member 15, and is configured as an end that is pivotably attached to the control surface 102 via a pivot shaft 104. That is, the link member 15 is pivotably connected to the control surface 102 at the pivot shaft attachment portion 15*a* at the first end. Note that the pivot shaft attachment portion 15*a* is rotatably attached to the pivot shaft 104, for example, via a bush serving as a bearing or a cylindrical sliding member.

Further, in this embodiment, the pivot shaft attachment portion 15*a* is provided as an end that is branched into three portions where the pivot shaft 104 passes through at the link member 15. On the other hand, the control surface 102 is provided with a bifurcated pivoting-side connection portion 102*b* that is rotatably connected to the pivot shaft 104 (see FIG. 1). Then, the bifurcated portions of the pivoting-side connection portion 102*b* are connected to the pivot shaft 104 in corresponding spaces between the above-described three end portions constituting the pivot shaft attachment portion 15*a*. Due to the structure connected to the pivot shaft 104 at a plurality of branched portions as described above, the link member 15 can pivotably drive the control surface 102 in a more stable manner.

The shaft portion 15*c* is provided as a shaft-like or columnar structure portion extending linearly along the longitudinal direction of the link member 15. The cross section of the shaft portion 15*c* that is perpendicular to the longitudinal direction is formed, for example, in a shape similar to that of H-steel. That is to say, the shaft portion 15*c* is shaped such that a pair of narrow flat plate-like portions that are provided parallel to each other and each have a substantially rectangular cross section are joined with a thick plate-like portion that is provided at the center in their width direction and substantially perpendicular thereto. Due to this cross sectional shape, the shaft portion 15*c* is configured to efficiently secure a geometrical moment of inertia and secure high rigidity while suppressing any increase in weight. Note that the shape of the shaft portion 15*c* need not be as described above. For example, the shaft portion 15*c* may take various shapes, including, for example, a columnar shape, a cylindrical shape, a prismatic shape, and the shape of a rectangular pipe.

The widened portion 15*b* is provided as a portion that joins together the pivot shaft attachment portion 15*a* that is branched into a plurality of portions and the shaft portion 15*c*. Also, the widened portion 15*b* is formed so as to extend in the width direction, which is perpendicular to the longitudinal direction of the link member 15. Note that the portion of the widened portion 15*b* that extends continuously to the shaft portion 15*c* is formed such that its width is gradually narrowed from the pivot shaft attachment portion 15*a* side to the shaft portion 15*c* side, providing a configuration with which stress concentration can be suppressed.

The connecting shaft attachment portion 15*d* is provided as the second end of the link member 15, and is configured as an end that is pivotably attached to a connecting shaft 18 that rotatably connects the link member 15 and a connecting member 16, which will be described below. Note that the connecting shaft attachment portion 15*d* is rotatably attached to the connecting shaft 18, for example, via a bush serving as a bearing or a cylindrical sliding member.

The link member 15 is installed in a position that overlaps a region between the plurality of rods (14*a*, 14*b*) in a direction perpendicular to the plane in which the plurality of rods (14*a*, 14*b*) are aligned parallel to each other.

In this embodiment, one connecting member 16 is provided as a member that is fixed to the rods 14 and to which the connecting shaft attachment portion 15*d* serving as the second end of the link member 15 is pivotably connected. The connecting member 16 is fixed to the plurality of rods (14*a*, 14*b*) so as to couple together the ends of the plurality of rods (14*a*, 14*b*) that project from the cylinders 11 toward the opposite side from the control surface 102 side.

Also, the connecting member 16 includes a rod coupling portion 16*a* and a link connecting portion 16*b*. The rod coupling portion 16*a* is provided as a portion that extends along a direction parallel to the direction in which the cylinders (11*a*, 11*b*) are aligned, and that couples the end of the rod 14*a* on the opposite side from the control surface 102 side and the end of the rod 14*b* on the opposite side from the control surface 102 side.

The link connecting portion 16*b* is provided as a bifurcated portion that projects from the central part of the rod coupling portion 16*a* in a direction in which the rod coupling portion 16*a* extends so as to couple the plurality of rods (14*a*, 14*b*). Also, the link connecting portion 16*b* extends so as to bend toward the link member 15 side at its distal end projecting from the rod coupling portion 16*a*, and is rotatably connected to the connecting shaft attachment portion 15*d* via the connecting shaft 18. Note that the connecting shaft attachment portion 15*d* is attached to the connecting shaft 18 between the bifurcated portions of the link connecting portion 16*b*.

Next, the operation of the fluid actuator 1 will be described. When the control surface 102 is driven by the fluid actuator 1, the fluid feeder is operated based on instructions from a controller, which is not shown, and a pressure fluid is supplied to and discharged from the cylinders (11*a*, 11*b*) of the fluid actuator 1. As a result of supplying/discharging the pressure fluid, the rods (14*a*, 14*b*) are displaced such that they extend from and contract into the cylinders (11*a*, 11*b*).

Accordingly, as a result of the rods (14*a*, 14*b*) being operated such that they extend from and contract into the cylinders (11*a*, 11*b*), the connecting member 16 coupled to the rods (14*a*, 14*b*) is also displaced together with the rods (14*a*, 14*b*). Then, the displacement of the connecting member 16 also causes the link member 15 to be displaced together with the connecting member 16.

As described above, the first end of the link member 15 is rotatably connected to the pivot shaft 104, and the second end thereof is rotatably connected to the connecting shaft 18. Accordingly, when being displaced together with the connecting member 16, the link member 15 is displaced while pivoting. Thereby, the link member 15 pivots relative to the connecting member 16 about the connecting shaft 18, while being displaced together with the connecting member 16, and causes the pivot shaft 104 to pivot about the fulcrum shaft 103, thus pivotably driving the control surface 102. That is, the control surface 102 is driven by the fluid actuator 1 so as to pivot about the fulcrum shaft 103. In FIG. 1, the range in which the center of the pivot shaft 104 pivots relative to the center of the fulcrum shaft 103 is indicated by the double-ended arrow of the alternate long and short dash line, and the pivot angle of the fulcrum shaft 103 relative to the pivot shaft 104 is also indicated by the alternate long and short dash line.

As has been described thus far, according to this embodiment, the rods 14 are displaced parallel to the cylinder axial direction with the movement of the pistons 13, and extend from and contract into the cylinders 11. As a result of the extension/contraction operation of the rods 14, the connecting member 16 fixed to the rods 14 is displaced, which causes the link member 15 to pivot, thus pivotably driving the control surface 102. Furthermore, according to this embodiment, the link member 15 whose first end is pivotably connected to the control surface 102 is installed parallel or obliquely to the cylinder axial direction, and the second end of the link member 15 is pivotably connected to the connecting member 16 fixed to the rods 14. Accordingly, the drive output resulting from the extension/contraction operation of the rods 14 can be exerted on the control surface 102 on the opposite side from the side on which the rods 14 project from the cylinders 11 such that the drive output is inverted via the connecting member 16 and the link member 15. Thus, according to this embodiment, due to the structure in which the link member 15 is installed in alignment with the cylinders 11, it is possible to suppress an increase in length and size of the fluid actuator 1, without reducing the output level, and secure a sufficient length of the link member 15 by efficiently utilizing the space around the cylinders 11. This can significantly reduce the force in the bending direction that acts on the rods 14. Also, according to this embodiment, due to the structure in which the motions of the rods 14 on the cylinder output side and the motions of the link member 15 are inverted, the distance between the centers of the fulcrum shaft 103 and the pivot shaft 104 can be set short, which makes it possible to decrease the loading envelope serving as the installation space for the fluid actuator 1. Accordingly, it is possible to cope with the thinned wing 101.

Further, according to this embodiment, there is no constraint on the structure as in the fluid actuator disclosed in FIG. 1 of JP 2000-65011A, or in other words, there is no such constraint as in a structure in which the movable-side structure is driven by bending the rod loosely fitted in the outer cylinder. Accordingly, it is possible to suppress generation of a constraint on the structure of the rods 14. Furthermore, according to this embodiment, the body portion 12 provided integrally with the cylinders 11 is fixed to the wing 101, and therefore, the cylinders 11 will not pivot relative to the wing 101. Thus, according to this embodiment, the cylinders 11 will not pivot relative to the wing 101 serving as the fixed-side structure, and moreover, an increase in length and size of the fluid actuator 1 can be suppressed. Thus, it is possible to increase the compactness of the installation space.

Therefore, according to this embodiment, it is possible to provide a fluid actuator 1 that can significantly reduce the force in the bending direction that acts on the rods 14, suppress generation of a constraint on the structure of the rods 14, and also increase the compactness of the installation space by suppressing an increase in length and size.

Furthermore, according to this embodiment, the link member 15 is installed in a position that overlaps a region between the plurality of the rods 14 (14*a*, 14*b*) in the perpendicular direction, and it is therefore possible to transmit the drive output to the control surface 102 in a stable and efficient manner, using a smaller number of the link members 15 than the number of the rods 14. This can efficiently ensure further stability of operation with a light weight structure.

Furthermore, according to this embodiment, the plurality of rods 14 (14*a*, 14*b*) are coupled together with the connecting member 16, and it is therefore possible to efficiently prevent the occurrence of a force fight in which the plurality of rods 14 bias the link member 15 in opposite directions due to displacement between the positions of the rods 14. This can efficiently achieve further stability of operation and the synchronization of operation.

Although an embodiment of the present invention has been described thus far, the present invention is not limited to the embodiment described above, and various modifications may be made within the scope recited in the claims. For example, the following modifications are possible.

(1) Although the above embodiment has been described, taking, as an example, a configuration in which the fluid actuator is configured to be used for driving a moving surface of an aircraft, this need not be the case. The present invention can be widely applicable as a fluid actuator that pivotably drives a movable-side structure pivotably connected to a fixed-side structure. For example, the present invention is applicable to fluid actuators that are used in aircrafts, helicopters, or flying objects for driving the movable-side structure so as to pivot relative to the fixed-side structure. In this case, the present invention is applicable to both manned aircrafts and helicopters and unmanned aircrafts and helicopters.

(2) Although the above embodiment has been described taking, as an example, a configuration in which two cylinders and two rods are provided and one connecting member and one link member are provided, this need not be the case. It is possible to implement a configuration in which the numbers of cylinders, rods, connecting members, and link members are modified.

(3) Although the above embodiment has been described taking, as an example, a configuration in which the body portion is provided integrally with the cylinders, this need not be the case. It is possible to implement a configuration in which the body portion is fixed to the cylinders. Although the above embodiment has been described, taking, as an example, a configuration in which the rods are provided integrally with the pistons, this need not be the case. It is possible to implement a configuration in which the rods are fixed to the pistons.

(4) The shapes of the cylinders, the rods, the connecting member, and the link member are not limited to the configurations described in the above embodiment, and various modifications may be made.

The present invention is widely applicable to a fluid actuator that is operated by supply and discharge of a fluid and that pivotably drives a movable-side structure pivotably connected to a fixed-side structure. The present invention is not limited to the above-described embodiment, and all modifications, applications and equivalents thereof that fall within the claims, for which modifications and applications would become apparent by reading and understanding the present specification, are intended to be embraced therein.

What is claimed is:

1. A fluid actuator that is operated by supply and discharge of a fluid and that pivotably drives a movable-side structure pivotably connected to a fixed-side structure, the fluid actuator comprising:

a cylinder to and from which a fluid is supplied and discharged;

a body portion that is fixed to the fixed-side structure and with which the cylinder is provided integrally or to which the cylinder is fixed;

a piston that defines a cylinder chamber inside the cylinder and that slides on an inner wall of the cylinder;

a rod that is provided integrally with or fixed to the piston and that is displaced so as to extend from and contract into the cylinder;

a link member that is installed so as to extend parallel to the axial direction of the cylinder or installed so as to extend obliquely to a direction parallel to the axial direction of the cylinder and whose first end is pivotably connected to the movable-side structure, wherein the link member is movable in a direction parallel to or oblique to the axial direction of the cylinder; and a connecting member that is fixed to the rod and to which a second end of the link member is pivotably connected, wherein the fluid actuator is configured to change distance between the connecting member and the movable-side structure in the axial direction of the cylinder in accordance with displacement of the rod.

2. The fluid actuator according to claim 1, wherein a plurality of rods, each serving as the rod, installed parallel to each other are provided, and the link member is installed in a position between the plurality of the rods in a direction perpendicular to a plane in which the plurality of the rods that are parallel to each other are aligned.

3. The fluid actuator according to claim 1, wherein a plurality of rods, each serving as the rod, installed parallel to each other are provided, and the connecting member is fixed to the plurality of the rods so as to couple ends of the plurality of the rods together.

4. The fluid actuator according to claim 2, wherein the connecting member is fixed to the plurality of the rods so as to couple ends of the plurality of the rods together.

5. The fluid actuator according to claim 1, wherein the connecting member is connected to the second end of the link member, which differs from the first end of the link member.

6. The fluid actuator according to claim 1, wherein the connecting member is connected to the second end of the link member, which is distanced from the first end of the link member at least in the axial direction of the cylinder.

* * * * *